US011511297B2

(12) United States Patent
Kraft et al.

(10) Patent No.: US 11,511,297 B2
(45) Date of Patent: Nov. 29, 2022

(54) NOZZLE DEVICE FOR DISPENSING TWO APPROACHING JETS OF A MEDIUM TO BE DISPENSED

(71) Applicant: Dürr Systems AG, Bietigheim-Bissingen (DE)

(72) Inventors: Bernd Kraft, Steinheim-Höpfigheim (DE); Dmitri Noak, Stuttgart (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 228 days.

(21) Appl. No.: 16/349,302

(22) PCT Filed: Nov. 29, 2017

(86) PCT No.: PCT/EP2017/080821

§ 371 (c)(1),
(2) Date: May 13, 2019

(87) PCT Pub. No.: WO2018/099969

PCT Pub. Date: Jun. 7, 2018

(65) Prior Publication Data

US 2020/0179967 A1 Jun. 11, 2020

(30) Foreign Application Priority Data

Nov. 30, 2016 (DE) ..... 10 2016 014 270.7

(51) Int. Cl.
*B05B 7/08* (2006.01)
*B05B 1/04* (2006.01)
(Continued)

(52) U.S. Cl.
CPC ..... *B05B 7/0846* (2013.01); *B05B 1/044* (2013.01); *B05B 1/14* (2013.01); *B05B 7/0807* (2013.01); *B05C 5/027* (2013.01)

(58) Field of Classification Search
CPC ..... B05B 7/08; B05B 7/0846; B05B 1/044; B05B 1/14; B05B 7/0807; B05C 5/0204; B05C 5/027; B05C 5/0283
(Continued)

(56) References Cited

U.S. PATENT DOCUMENTS 866,163 A * 9/1907 Shafer ..... F23D 14/04 239/429
1,186,117 A 6/1916 Moe
(Continued)

FOREIGN PATENT DOCUMENTS

CA 2830651 A1 10/2012
CN 1200685 A 12/1998
(Continued)

OTHER PUBLICATIONS

International Search Report and Written Opinion for PCT/EP2017/080821 dated Mar. 8, 2018 (15 pages; with English translation).
(Continued)

*Primary Examiner* — Jason J Boeckmann
(74) *Attorney, Agent, or Firm* — Bejin Bieneman PLC

(57) ABSTRACT

The disclosure relates to a nozzle device for emitting an emission medium onto a component, preferably for emitting the emission medium onto two side faces and preferably an end face of a fold, an edge or a transition joint of the component. The nozzle device comprises an opening configuration for emitting the emission medium and is distinguished particularly in that the opening configuration comprises at least two openings for emitting at least two jets of the emission medium and the at least two openings are oriented inwardly so that the at least two jets approach one another toward the emission side.

20 Claims, 6 Drawing Sheets

(51) Int. Cl.
*B05B 1/14* (2006.01)
*B05C 5/02* (2006.01)

(58) Field of Classification Search
USPC ..... 239/433, 434, 543–545, 569, 592, 291, 239/294
See application file for complete search history.

(56) References Cited

U.S. PATENT DOCUMENTS

| | | | | |
|---|---|---|---|---|
| 2,284,443 | A | 5/1942 | Paradise | |
| 3,615,054 | A | 10/1971 | Botz | |
| 4,195,782 | A * | 4/1980 | Troup | B05B 1/00 239/230 |
| 4,476,165 | A | 10/1984 | Mcintyire | |
| 4,567,934 | A | 2/1986 | Nakao et al. | |
| 4,962,891 | A | 10/1990 | Layden | |
| 5,088,649 | A * | 2/1992 | Hanson | B05B 1/26 239/329 |
| 5,145,689 | A | 9/1992 | Allen | |
| 5,423,935 | A | 6/1995 | Benecke et al. | |
| 5,472,143 | A * | 12/1995 | Bartels | B05B 1/00 239/462 |
| 5,503,336 | A | 4/1996 | Wichmann | |
| 5,618,566 | A | 4/1997 | Allen | |
| 5,785,253 | A | 7/1998 | Ueberschar | |
| 5,845,846 | A | 12/1998 | Watanabe et al. | |
| 5,904,298 | A | 5/1999 | Kwok | |
| 5,976,249 | A | 11/1999 | Stahl | |
| 6,001,178 | A | 12/1999 | Borgmann | |
| 6,375,099 | B1 | 4/2002 | McGuffey | |
| 6,540,831 | B1 | 4/2003 | Craine | |
| 6,680,021 | B1 | 1/2004 | Kwok | |
| 7,255,292 | B2 | 8/2007 | Saidman | |
| 8,074,902 | B2 * | 12/2011 | Burmester | B05B 7/0884 239/553.5 |
| 9,138,753 | B1 | 9/2015 | Takahara | |
| 2003/0234303 | A1 * | 12/2003 | Berning | B60S 1/52 239/589.1 |
| 2004/0155125 | A1 | 8/2004 | Kramer et al. | |
| 2008/0145530 | A1 | 6/2008 | Bondeson | |
| 2013/0011552 | A1 | 1/2013 | Bondeson et al. | |
| 2014/0367481 | A1 | 12/2014 | Toh et al. | |
| 2015/0013900 | A1 | 1/2015 | Kwack et al. | |
| 2016/0016185 | A1 | 1/2016 | Park | |

FOREIGN PATENT DOCUMENTS

| | | | |
|---|---|---|---|
| CN | 1859984 | A | 11/2006 |
| CN | 1305593 | C | 3/2007 |
| CN | 101918144 | A | 12/2011 |
| CN | 105263636 | A | 1/2016 |
| CN | 105772264 | A | 7/2016 |
| CN | 106140563 | A | 11/2016 |
| DE | 20 48 865 | B2 | 2/1973 |
| DE | 19632642 | A1 | 2/1998 |
| DE | 102006012373 | B3 | 6/2007 |
| DE | 20 2010 002549 | U1 | 11/2010 |
| DE | 10 2013 217 686 | A1 | 3/2015 |
| EP | 0096453 | A2 | 12/1983 |
| EP | 1116521 | A2 | 7/2001 |
| JP | 2004283779 | A | 10/2004 |
| JP | 2015229151 | A | 12/2015 |
| WO | 2011081032 | A1 | 7/2011 |
| WO | 2012130867 | A1 | 10/2012 |

OTHER PUBLICATIONS

International Search Report and Written Opinion for PCT/EP2017/080803 dated Apr. 3, 2018 (12 pages; with English translation).
International Search Report and Written Opinion for PCT/EP2017/080834 dated Feb. 14, 2018 (13 pages; with English translation).
China National Intellectual Property Administration Office Action and Search Report for Application No. CN 201780074075.6 dated Aug. 21, 2020 (4 pages; with English translation of Search Report).
Chinese Office Action and Search Report for CN201780074227.2 dated Sep. 30, 2020 (10 pages; English translation not available).
USPTO Non-Final Office Action for U.S. Appl. No. 16/349,301 dated Dec. 22, 2020 (41 pages).
Chinese Office Action dated Sep. 1, 2020 for Patent Application No. CN201780074074.X (10 pages; with English translation).
Non-Final Office Action dated Mar. 11, 2021 for U.S. Appl. No. 16/349,300 (23 pages).
EPO Examination Report for Application No. EP 17816557.7 dated May 25, 2021 (6 pages; with English translation).
USPTO Final Office Action mailed in related U.S. Appl. No. 16/349,300 dated Feb. 22, 2022 (51 pages).
Chinese Office Action dated Dec. 3, 2021 for related application CN201780074227.2 (22 pages; with English machine translation).

* cited by examiner

NOZZLE DEVICE FOR DISPENSING TWO APPROACHING JETS OF A MEDIUM TO BE DISPENSED

CROSS-REFERENCE TO RELATED APPLICATIONS

This application is a national stage of, and claims priority to, Patent Cooperation Treaty Application No. PCT/EP2017/080821, filed on Nov. 29, 2017, which application claims priority to German Application No. DE 10 2016 014 270.7, filed on Nov. 30, 2016, which applications are hereby incorporated herein by reference in their entireties.

BACKGROUND

The disclosure relates to a nozzle device for emitting a preferably viscous, in particular highly viscous, emission medium onto a component, preferably for emitting the emission medium onto two side faces and optionally an end face of a fold (e.g. a standing seam), an edge or a transition joint of the component. The component is preferably a motor vehicle component (e.g. a vehicle bodywork component), although it can also be, for example, a component of a commercial vehicle (e.g. a commercial vehicle bodywork component), a component of an aircraft, a window (e.g. a window pane) or a facade component.

With regard to the general prior art, reference is made initially to DE 196 32 642 A1.

Making reference to FIG. 10, according to the prior art, in particular, standing seams (e.g. component edges) as occur for example in the door sill region or on side rails of a motor vehicle, are sealed with conventional, robot-guided flat jet nozzles (also known as flatstream nozzles) made of hard metal. In this method, the standing seam is sealed from at least one side and possibly also from both sides with PVC (polyvinylchloride). So that the underside of the standing seam can be sealed reliably, a robot program is usually created so that the lower edge of the spray jet delivered from the nozzle is applied a few millimetres below the standing seam and is therefore applied past ("shot past") the standing seam. The PVC material that is applied on one side of the standing seam becomes partially applied round the seam edge and so seals the lower corrosion-susceptible side of the standing seam.

The requirements for a conventional PVC seam are typically 15 mm to 25 mm seam width and 1.5 mm to 2.5 mm seam height. So that this can be realized with a structurally limited nozzle, the slit opening of the conventional flat jet nozzle is configured convex so that the jet width of the spray jet increases toward the standing seam and thus toward the emission side.

One disadvantage of the prior art described above is that, as a result of the process, a part of the PVC material is "shot past" at the standing seam. This has the result that the robot guiding the flat jet nozzle and/or the application cell in which the method is carried out is soiled and therefore a greater cleaning effort is incurred. Due to the structural tolerances that are typically present in motor vehicle bodywork, the application usually cannot be set differently. The component tolerances also have the result that application to the standing seam must be made from both sides. Joined sheet metal edges differ, for example in their length, from one bodywork to the next.

DETAILED DESCRIPTION

Figure 1:
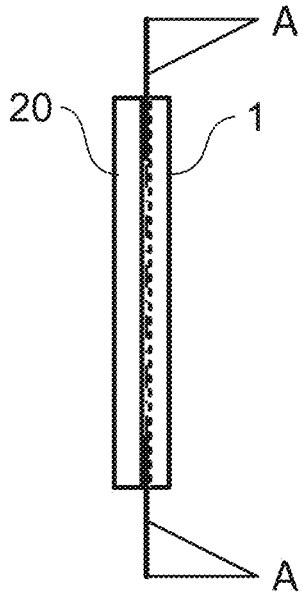
FIG. 1 shows a side view of a nozzle device with a counterplate according to one example of the disclosure.

The disclosure provides a possibility for emitting a viscous emission medium onto at least two side faces of a component, preferably for example a fold, an edge or a transition joint of the component, such that the required quantity of emission medium can be reduced.

The disclosure provides a nozzle device for emitting an emission medium onto a component, preferably for emitting the emission medium onto two side faces and/or an end face of a fold (e.g. a standing seam), an edge or a transition joint of the component.

The component is preferably a motor vehicle component, for example, a motor vehicle bodywork.

However, the component can also be a component of a commercial vehicle (e.g. a commercial vehicle bodywork component), a component of an aircraft, a window (e.g. a window pane) or a facade component.

Application fields for the nozzle device are therefore, in particular: motor vehicles, commercial vehicles, aircraft, windows and/or facade construction.

The nozzle device includes an opening configuration for emitting the emission medium and has at least two openings for emitting at least two jets of the emission medium and the at least two openings are oriented inwardly so that the at least two jets approach one another toward the emission side.

Accordingly, one or more of the following advantages can be achieved:

- The consumption of emission medium can be reduced.
- The soiling of an application cell can be reduced.
- A reliable sealing of different fold types, in particular standing seams, can be enabled.
- A component measuring system for measuring the (motor vehicle) component can be dispensed with.
- A high application speed can be achieved, in particular as compared with application methods with component measurement.
- A larger spraying distance between the nozzle device and the (motor vehicle) component can be enabled, e.g. up to 50 mm.
- Larger component tolerances can be enabled, for example +/−3 mm to 5 mm.
- Due to the simple construction of the nozzle device, preferably there is no additional interfering outline at the applicator and/or at the robot, so that for example, even difficult to access sites such as folds, seams, edges, etc. can be readily reached.

By increasing the outflow rate of the emission medium, the application of a conventional seam, for example, made of PVC onto the (vehicle) component can also be enabled.

The nozzle device is suitable in particular for at least one of the following application possibilities:

Sealing, for example, metallic (motor vehicle) components which are to be welded or glued, e.g. folds (in particular standing seams) or transition joints, but also, for example, component edges of individual components.

For example, 3-sided encompassing (enclosing) application (coating) of a, for example, viscous or highly viscous emission medium onto a (vehicle) component, for corrosion protection of cut edges on, for example, metal sheets, protection against injury during manual component handling (e.g. with sharp-edged metal sheets), protection against edge damage (e.g. with fibre composite materials) and/or abrasion resistance.

The at least two openings can be configured, for example, as slit openings so that the at least two jets are preferably flat jets.

It is possible that the at least two openings are oriented in the same plane or are oriented at least parallel to one another so that the jets can preferably extend substantially in the same plane.

A material cut-out for feeding the emission medium to the at least two openings can be incorporated into the nozzle device.

The material cut-out can comprise, for example, a conduit portion for the emission medium, via which the emission medium is feedable to the at least two openings, so that the at least two openings are preferably connected to the same conduit portion.

The nozzle device, preferably the material cut-out, can be configured in particular in order to subject the emission medium to be fed to the at least two openings respectively to at least one direction change laterally outwardly and at least one direction change laterally inwardly.

It is possible that the material cut-out opens into the at least two openings and, on the dispensing side, forms the at least two openings.

It is possible that the conduit portion is divided into two channel portions, wherein one channel portion leads to one opening and the other channel portion leads to the other opening.

The material cut-out can have, for example, a chamber portion arranged downstream of the conduit portion, wherein the chamber portion leads to the at least two openings.

The passage cross-section of the chamber portion can suitably be larger, at least in sections, than the passage cross-section of the conduit portion.

The material cut-out can be formed in cross-section at least in sections substantially flat (e.g. slit-shaped and/or substantially rectangular), but alternatively or additionally also at least in sections, substantially round (e.g. with a bore or in a 3-D print variant).

The material cut-out can comprise inner flanks outwardly on both sides, in order to deflect the emission medium inwardly to the at least two openings.

The opening configuration can have at least three openings.

It is possible that the opening configuration has at least one third opening between the at least two openings for emitting a third jet of the emission medium.

The at least two openings and preferably the third opening can be oriented, for example, in the same plane or parallel to one another so that, for example, the jets from the two openings and preferably the jet from the third opening extend substantially in the same plane.

It is possible that the end face on the dispensing side of the nozzle device and/or the opening configuration and thus the at least two openings can suitably be formed concave, e.g. concavely curved. In this way it can be enabled that the two jets approach one another toward the emission side.

It is possible that a protruding horn structure can be arranged on both sides externally beside the at least two openings and the horn structure can comprise, for example, at least two inwardly formed inner flanks.

The inner flanks can preferably act upon the jets emitted from the at least two openings in order to deflect the jets inwardly.

The nozzle device can be configured as a nozzle head, where the nozzle head preferably represents a single-piece integral component and can, for example, be manufactured from a single piece.

The nozzle device can, however, also be configured as a nozzle plate.

The nozzle device configured as a nozzle plate can be a counterplate for arrangement adjoining the nozzle plate so that the nozzle device can also be configured as multi-part.

The counterplate can be configured, in particular, in order to close the at least two openings in the peripheral direction in order to close the material cut-out in the peripheral direction, and/or on the dispensing side, formed complementary to the opening configuration having the at least two openings in order preferably to close substantially flush with the opening configuration.

The at least two jets and preferably the third jet are preferably flat jets which can extend, for example, substantially in the same plane.

It is possible that the at least two openings are oriented inwardly such that the at least two jets form a tapering angle of greater than 5°, greater than 10°, greater than 15°, greater than 90°, greater than 95° or greater than 100° and less than 180°.

The emission medium can be a gas and/or a viscous, in particular a highly viscous, emission medium (e.g. PVC: polyvinylchloride).

The opening width of the at least two openings and preferably the third opening in its transverse direction can have a value of between 0.2 mm and 0.5 mm.

The opening configuration can comprise at least three or even at least four openings.

The application medium can comprise, for example, PVC (polyvinylchloride) and/or a PVC plastisol. In the field of automotive painting, sealing and gluing high viscosity is considered to be above about 1 Pas, with sealing application considered to have a maximum of about 10 Pas and gluing applications to have a maximum of about 2500 Pas.

The features "concave" and "concavely bent" in the context of the disclosure preferably substantially comprise arched concave configurations, although they are not restricted thereto, but can also comprise, for example, linear concave configurations.

The disclosure is not restricted to a nozzle device, but also covers a method for emitting an emission medium onto a component, preferably for emitting the emission medium onto two side faces and/or an end face of a fold, an edge or a transition joint of the component.

The method is carried out, in particular, with a nozzle device as disclosed herein, so that the nozzle device has, in particular, an opening configuration for emitting the emission medium.

The method is distinguished in that the opening configuration comprises at least two openings for emitting at least two jets of the emission medium and the at least two openings are oriented inwardly so that the at least two jets approach one another toward the emission side.

It is possible that the nozzle device, in particular the opening configuration and the fold, the edge or the transition joint are oriented at the end face substantially toward one another during the emission of the emission medium and the emission medium nevertheless impacts on two side faces and preferably an end face of the fold, the edge or the transition joint.

The method is preferably carried out with a nozzle device as disclosed herein, so that the disclosure made regarding the nozzle device suitably also applies for the method.

The examples of the disclosure described making reference to the drawings partially match one another, wherein similar or identical parts are provided with the same reference signs and for their explanation, reference is also made, for the avoidance of repetition, to the description of other examples or figures.

Figure 2:
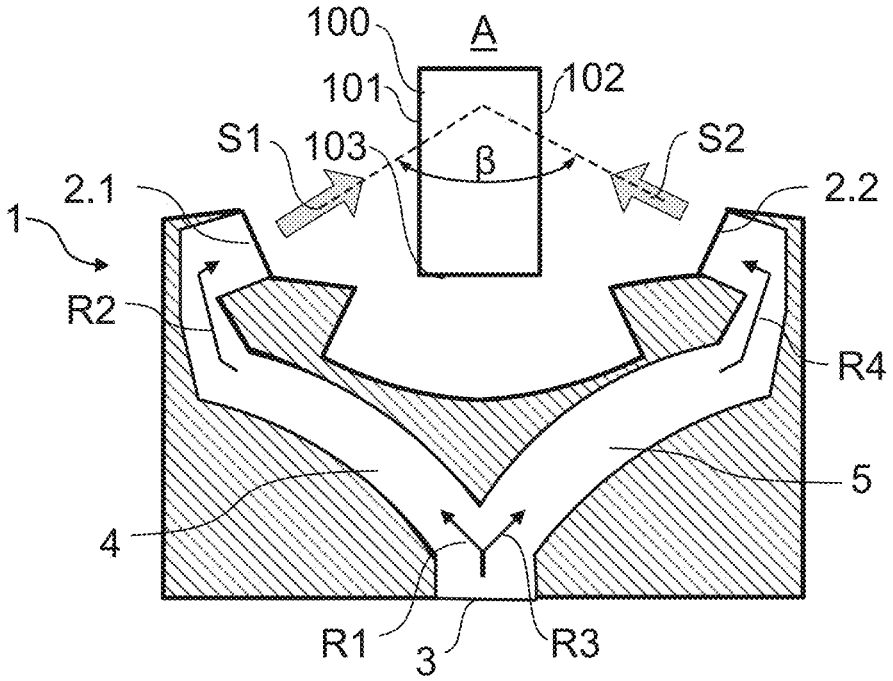
FIG. 2 shows a longitudinal sectional view along the line A-A of FIG. 1.
Figure 3:
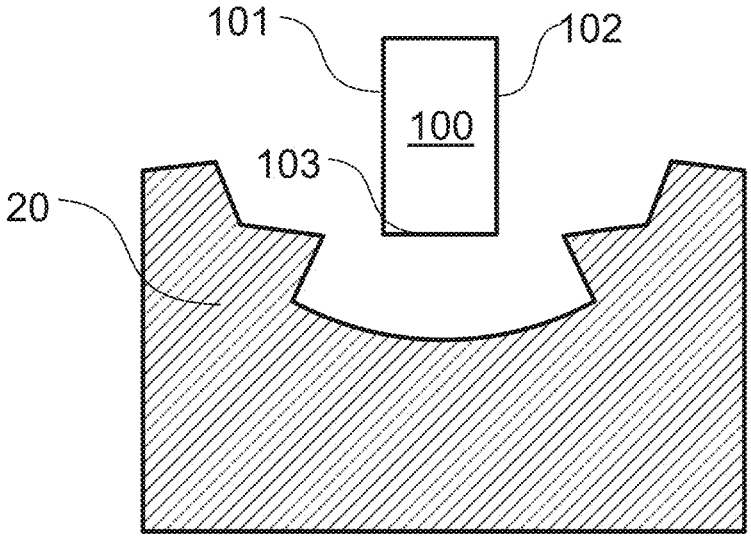
FIG. 3 shows a sectional view of the counterplate of FIG. 1.

FIG. 1 shows a side view of a nozzle device 1 configured as a nozzle plate with a counter plate 20 according to one example of the disclosure, and FIG. 2 shows an associated longitudinal sectional view along the line A-A of FIG. 1, and FIG. 3 shows a sectional view of the counterplate 20.

The nozzle device 1 and the counterplate 20 will now be described making reference jointly to FIGS. 1 to 3.

The nozzle device 1 serves to emit a viscous or highly viscous emission medium (e.g. PVC) onto a component 100, preferably a motor vehicle component 100, preferably to emit the emission medium onto two side faces 101, 102 and optionally an end face 103 of a fold, an edge or a transition joint of the motor vehicle component 100.

The nozzle device 1 comprises an opening configuration for emitting the emission medium. The opening configuration has two openings 2.1, 2.2 for emitting two jets S1, S2 of the emission medium. The openings 2.1, 2.2 are preferably configured as slit openings for emitting flat jets, but can also be configured, for example, concave or convex.

The two openings 2.1, 2.2 are oriented inwardly in the same plane, so that the two jets S1, S2 approach one another toward the emission side A.

During the emission of the application medium, the nozzle device 1 and the motor vehicle component 100, in particular for example a fold, an edge or a transition joint of the motor vehicle component 100 can be substantially oriented at the end side toward one another. Nevertheless, due to the two inwardly directed jets S1, S2, the emission medium impacts onto two side faces 101, 102 of the motor vehicle component 100.

In the embodiment shown in FIG. 2, the jets S1, S2 impact only on the side faces 101, 102 of the motor vehicle component 100. However, embodiments are possible in which the jets S1, S2 also impact on the end face 103. The two jets S1, S2 can thus be oriented such that on impacting on the motor vehicle component 100, they encompass (enclose) it suitably on three sides, so that the emission medium advantageously need not be applied past the motor vehicle component 100.

The two openings 2.1, 2.2 are oriented inwardly such that the two jets S1, S2 enclose a tapering angle β of approximately 120°, whereby in general, tapering angles β of greater than 5°, greater than 10°, greater than 15°, greater than 90°, greater than 95° or greater than 100° and less than 180° are possible.

A material cut-out 3, 4, 5 is incorporated into the nozzle device 1 for feeding the emission medium to the two openings 2.1, 2.2. The material cut-out 3, 4, 5 comprises a conduit portion 3 for the emission medium, via which the emission medium is feedable to the two openings 2.1, 2.2, so that the two openings 2.1, 2.2 are together connected to the same conduit portion 3. The conduit portion 3 is divided into two channel portions 4, 5 wherein one channel portion 4 leads to the opening 2.1 and the other channel portion 5 leads to the opening 2.2.

The material cut-out 3, 4, 5 is configured such that the emission medium to be fed to the two openings 2.1, 2.2 is subjected respectively to a direction change R1, R3 laterally outwardly and at least one direction change R2, R4 laterally inwardly.

The material cut-out 3, 4, 5 opens into the two openings 2.1, 2.2 and thereby forms the two openings 2.1, 2.2 on the dispensing side.

The material cut-out 3, 4, 5 is formed substantially flat and/or slit-shaped in cross-section, whereby round versions can also be embodied (e.g. with boring or in a 3-D printed variant).

The counterplate 20 serves for arrangement beside the nozzle device 1 configured as a nozzle plate and is designed to close the two openings 2.1, 2.2 in the peripheral direction in order to close the material cut-out 3, 4, 5 in the peripheral direction and on the dispensing side is designed complementary to the opening configuration having the two openings 2.1, 2.2.

Figure 4:
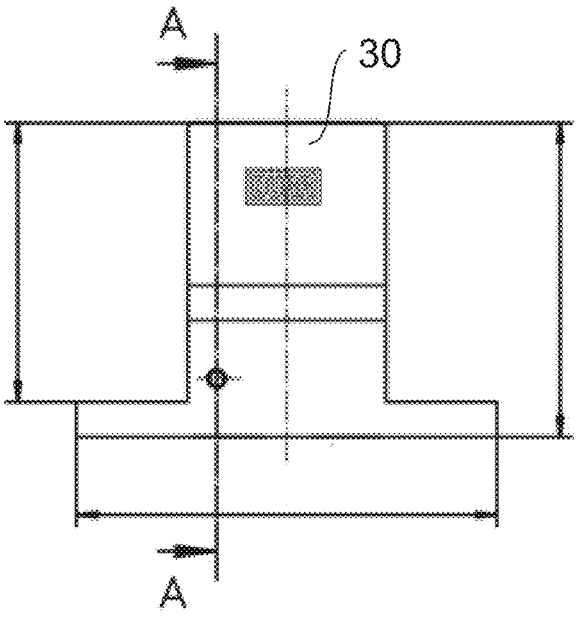
FIG. 4 shows a side view of a plate holder for a nozzle device according to one example of the disclosure.
Figure 5:
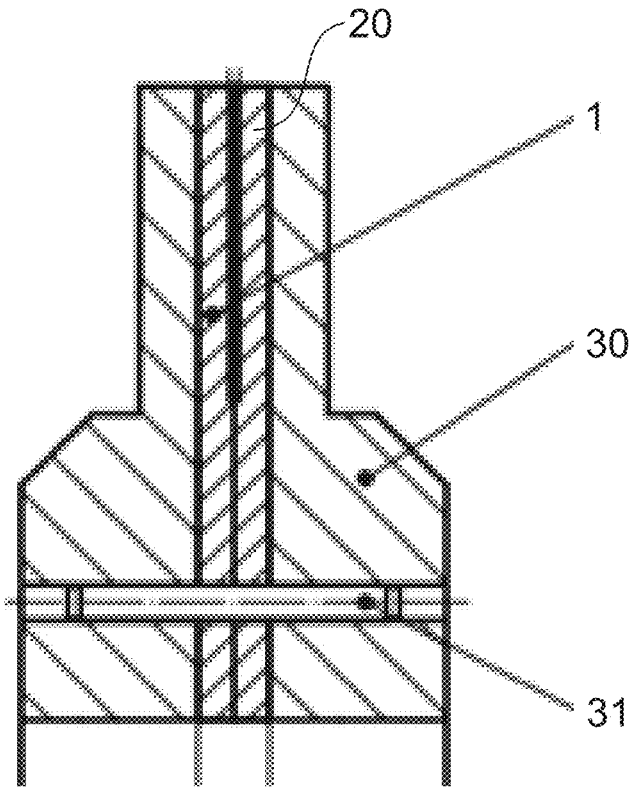
FIG. 5 shows a sectional view of a nozzle device with a counterplate according to one example of the disclosure and the plate holder of FIG. 4.
Figure 6:
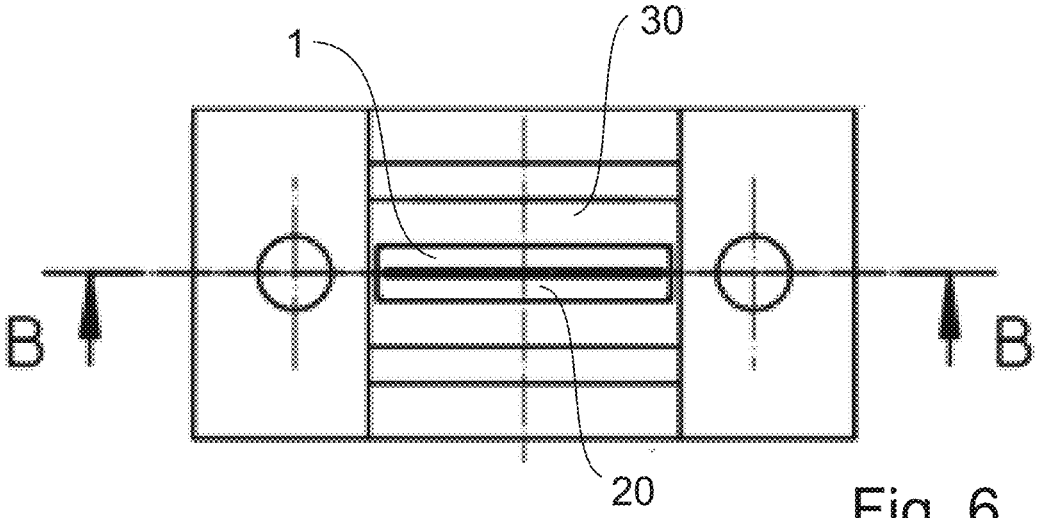
FIG. 6 shows a plan view of the nozzle device, the counterplate and the plate holder of FIGS. 4 and 5.
Figure 7:
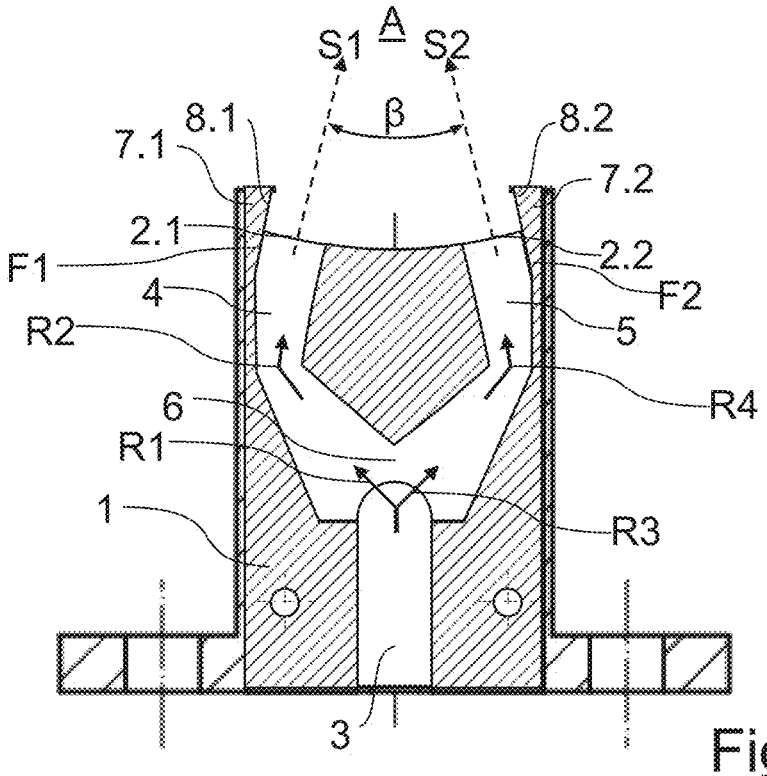
FIG. 7 shows a sectional view along the line B-B of FIG. 6.

FIG. 4 shows a side view of a plate holder 30 comprising preferably two clamping parts (e.g. clamping plates) for a nozzle device 1 according to one example of the disclosure, wherein FIG. 5 shows a sectional view along the line A-A of FIG. 3, and FIG. 6 shows an associated plan view and FIG. 7 shows a sectional view along the line B-B of FIG. 6.

Reference will now be made to FIGS. 4 to 7.

The nozzle device 1 configured as a nozzle plate serves to emit an emission medium onto a motor vehicle component 100 (see e.g. FIG. 3) and comprises an opening configuration for emitting the emission medium. The opening configuration comprises two openings 2.1, 2.2 for emitting two jets S1, S2 of the emission medium. The two openings 2.1, 2.2 are oriented inwardly, so that the two jets S1, S2 approach one another toward the emission side A at a taper angle β of approximately 30°.

Arranged on both sides externally adjoining the two openings 2.1, 2.2 is a protruding horn structure 7.1, 7.2. The horn structure 7.1, 7.2 comprises two inwardly formed inner flanks 8.1, 8.2. The inner flanks 8.1, 8.2 are configured to act upon the jets S1, S2 output from the two openings 2.1, 2.2, so that the jets S1, S2 are deflectable inwardly. The horn structure 7.1, 7.2 is optional.

The opening configuration and thus the two openings 2.1, 2.2 and also the end face on the dispensing side of the nozzle device 1 are formed preferably concave, suitably concavely curved. The two openings 2.1, 2.2 are also oriented inwardly, so that the jets S1, S2 approach one another toward the emission side A, even without the optional horn structure 7.1, 7.2.

The nozzle device 1 and the counterplate 20 which is formed complementary are arranged between the two clamping parts of the plate holder 30 in order to be held and fixed thereby. A fixing 31 serves to clamp the two clamping parts of the plate holder 30 and thereby to jam the nozzle device 1 and the counterplate 20.

A material cut-out 3, 4, 5, 6 is incorporated into the nozzle device 1 for feeding the emission medium to the two openings 2.1, 2.2. The material cut-out 3, 4, 5, 6 comprises a conduit portion 3 for the emission medium, via which the emission medium is feedable via a chamber portion 6 to the two openings 2.1, 2.2, so that the two openings 2.1, 2.2 are together connected to the same conduit portion 3.

The nozzle device 1, preferably the material cut-out 3, 4, 5, 6, is configured in order to subject the emission medium to be fed to the two openings 2.1, 2.2 respectively to a direction change R1, R3 laterally outwardly and a direction change R2, R4 laterally inwardly.

The material cut-out 3, 4, 5, 6 opens into the two openings 2.1, 2.2 and thereby forms the two openings 2.1, 2.2 on the dispensing side.

The passage cross-section of the chamber portion 6 is larger, at least in sections, than the passage cross-section of the conduit portion 3.

The material cut-out 3, 4, 5, 6 further comprises inner flanks F1, F2 externally on both sides in order to deflect the emission medium inwardly to the two openings 2.1, 2.2. The inner flanks F1, F2 are optional, like the horn structure 7.1, 7.2.

Figure 8:
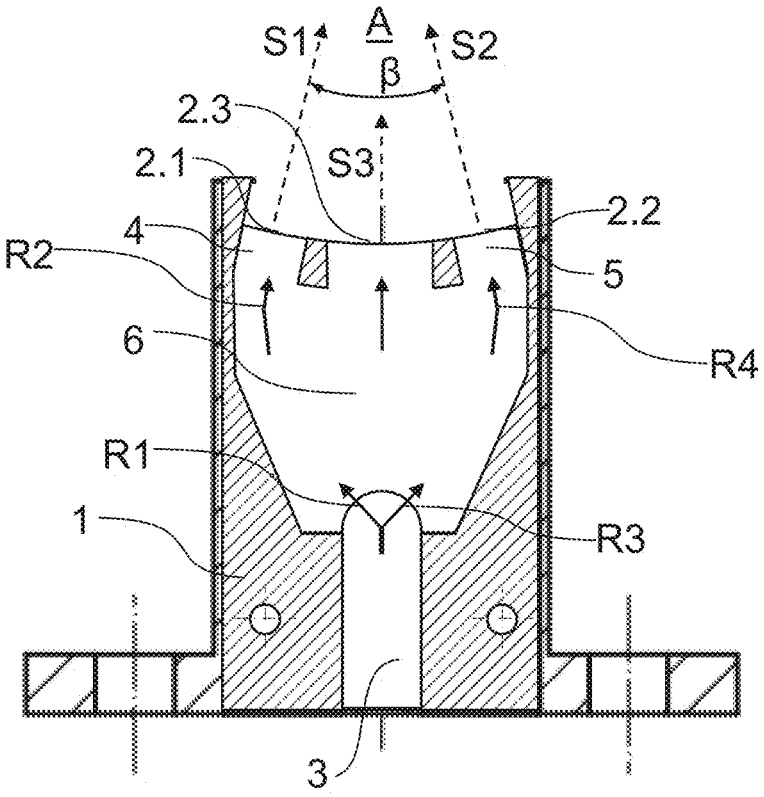
FIG. 8 shows a sectional view of a nozzle device according to another example of the disclosure.

FIG. 8 shows a sectional view of a nozzle device 1 according to another example of the disclosure.

The nozzle device 1 serves to emit an emission medium onto a motor vehicle component 100 (see e.g. FIG. 3) and comprises an opening configuration for emitting the emission medium. The opening configuration has three openings 2.1, 2.2, 2.3 for emitting three jets S1, S2, S3 of the emission medium.

The two openings 2.1, 2.2 are oriented inwardly, so that the two jets S1, S2 approach one another toward the emission side A. The third opening 2.3 is arranged between the two openings 2.1, 2.2 and oriented so that the jet S3 is output substantially parallel to the central axis of the nozzle device 1.

The three openings 2.1, 2.2, 2.3 are suitably oriented in the same plane so that the jets S1, S2, S3 also extend substantially in the same plane.

The horn structure (7.1, 7.2) shown in FIG. 7 and the inner flanks (F1, F2) of the material cut-out 3, 4, 5, 6 are further optional.

During the emission of the application medium, the nozzle device 1 and the motor vehicle component 100, in particular for example a fold, an edge or a transition joint can be substantially oriented at the end side toward one another. Nevertheless, due to the inwardly directed jets S1, S2, the emission medium can impact onto two side faces 101, 102 and due to the jet S3, the emission medium can additionally impact upon an end face 103 of the motor vehicle component 100.

Figure 9:
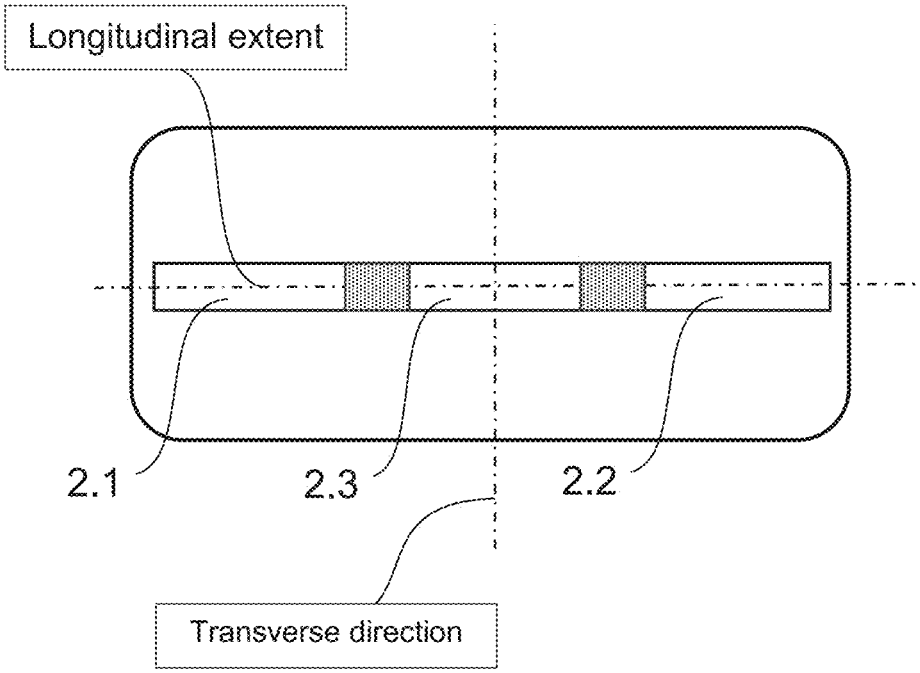
FIG. 9 shows a schematic plan view of the nozzle device of FIG. 8.
Figure 10:
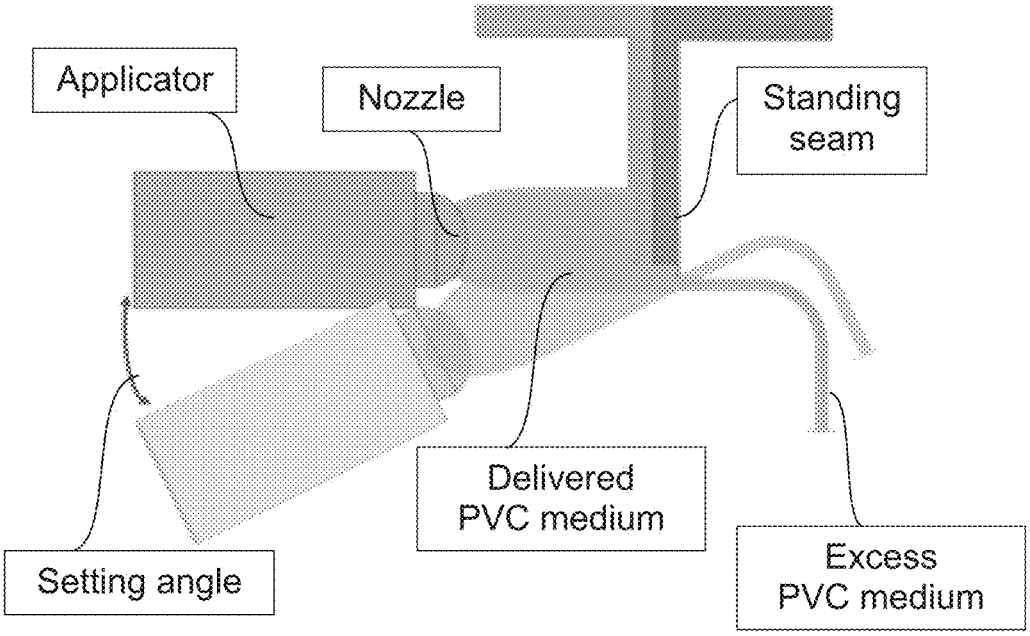
Prior Art Fig. 10
FIG. 10 shows an application process for sealing a standing seam according to the prior art.

FIG. 9 shows a schematic plan view of the nozzle device 1 of FIG. 8, specifically in particular the opening configuration with the three openings 2.1, 2.2, 2.3.

The opening width of the three openings 2.1, 2.2, 2.3 in the transverse direction thereof has a value of between 0.2 mm and 0.5 mm.

In the context of the disclosure, the two openings 2.1, 2.2 and preferably also the third opening 2.3 can be used for emission of a preferably viscous, in particular highly viscous, emission medium.

The nozzle device 1 shown in the drawings is configured as a nozzle plate for cooperation with a counterplate 20. In the context of the disclosure, however, it is also possible to configure the nozzle device as a nozzle head, wherein the nozzle head suitably consists of a single-piece integral component and can, for example, be manufactured from a single piece.

The disclosure is not restricted to the above described examples preferred exemplary embodiments. Rather a plurality of variants and derivations are possible which also make use of the inventive concept and therefore also fall within the protective scope. Furthermore, the disclosure also claims protection for the subject matter and the features of the subclaims separately from the features and claims to which they refer.

LIST OF REFERENCE NUMERALS

1 Nozzle device, preferably nozzle plate or nozzle head
2.1, 2.2 Two openings, preferably slit-shaped
2.3 Third opening, preferably slit-shaped
3 Conduit portion (material cut-out)
4 Channel portion (material cut-out)
5 Channel portion (material cut-out)
6 Chamber portion (material cut-out)
7.1, 7.2 Horn structure
8.1, 8.2 Inner flanks (horn structure)
20 Counterplate
30 Plate holder
31 Fixing
A Emission side
S1, S2 Jets, preferably flat jets
S3 Jet, preferably flat jet
R1 Direction change
R2 Direction change
R3 Direction change
R4 Direction change
F1, F2 Inner flanks (material cut-out)
100 Component, preferably motor vehicle component
101 Side face
102 Side face
103 End face
β Taper angle

The invention claimed is:

1. Nozzle device for emitting an emission medium onto a component, comprising:

an opening configuration for emitting the emission medium, characterised in that the opening configuration comprises at least two external openings for emitting at least two jets of the emission medium external of the nozzle and the at least two openings are oriented inwardly so that the at least two jets approach one another in a downstream direction;

a protruding horn structure arranged externally on both sides beside the at least two openings, the protruding horn structure including at least two inwardly formed inner flanks extending toward each other in the downstream direction and located downstream of the at least two openings; and an end face on a dispensing side of the nozzle device, the end face concave between the at least two openings.

2. Nozzle device according to claim 1, characterised in that the at least two openings are configured as slit openings.

3. Nozzle device according to claim 1, wherein the nozzle device includes a plate having a material cut-out, the material cut out incorporated into the nozzle device for feeding the emission medium to the at least two openings.

4. Nozzle device according to claim 3, characterised in that the material cut-out comprises a conduit portion for the emission medium, the at least two openings are together connected to the same conduit portion.

5. Nozzle device according to claim 3, characterised in that the material cut-out of the plate includes at least one direction change laterally outwardly and at least one direction change laterally inwardly.

6. Nozzle device according to claim 3, characterised in that the material cut-out opens into the at least two openings and forms the at least two openings.

7. Nozzle device according to claim 4, characterised in that the conduit portion of the material cut-out is divided into two channel portions wherein one channel portion leads to one opening and the other channel portion leads to the other opening.

8. Nozzle device according to claim 4, characterised in that the material cut-out comprises a chamber portion arranged downstream of the conduit portion, wherein the chamber portion leads to the at least two openings.

9. Nozzle device according to claim 8, characterised in that the passage cross-section of the chamber portion is larger, at least in sections, than the passage cross-section of the conduit portion.

10. Nozzle device according to claim 3, characterised in that the material cut-out has second inner flanks on both sides in order to deflect the emission medium inwardly to the at least two openings.

11. Nozzle device according to claim 3, characterised in that the material cut-out is formed flat and/or round in cross-section.

12. Nozzle device according to claim 1, characterised in that the opening configuration has at least one third opening between the at least two openings for emitting a third jet of an emission medium.

13. Nozzle device according to claim 1, characterised in that the at least two openings are oriented in the same plane or are oriented parallel to one another.

14. Nozzle device according to claim 1, characterised in that the inner flanks act upon the jets output from the at least two openings, in order to deflect the jets inwardly.

15. Nozzle device according to claim 1, characterised in that the nozzle device a) is configured as a nozzle plate, or b) is configured as a nozzle head and the nozzle head is a single-piece integral component.

16. Nozzle device according to claim 15, characterised in that the nozzle device comprises a counterplate for arranging beside the nozzle plate.

17. Nozzle device according to claim 16, characterised in that the counterplate comprises at least one of the following features:

a) the counterplate is configured to close the at least two openings in a peripheral direction, b) the counterplate is configured to close the material cut-out in the peripheral direction, c) the counterplate is configured complementary to the opening configuration comprising the at least two openings.

18. Nozzle device according to claim 1, characterised in that the at least two jets are flat jets and preferably extend substantially in the same plane.

19. Nozzle device according to claim 1, characterised in that the at least two openings are oriented inwardly such that the at least two jets form a tapering angle ($\beta$) of greater than 5°, greater than 10°, greater than 15°, greater than 90°, greater than 95° or greater than 100° and less than 180°.

20. Nozzle device according to claim 19, characterised in that the opening width of the at least two openings in its transverse direction has a value of between 0.2 mm and 0.5 mm.

* * * * *